US008746135B2

(12) United States Patent
Sakoguchi et al.

(10) Patent No.: US 8,746,135 B2
(45) Date of Patent: Jun. 10, 2014

(54) ACCUMULATING AND STRAPPING APPARATUS

(75) Inventors: Yoshitaka Sakoguchi, Yokohama (JP); Kazuhiro Mukai, Yokohama (JP); Takahito Shinfuku, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 270 days.

(21) Appl. No.: 13/233,746

(22) Filed: Sep. 15, 2011

(65) Prior Publication Data

US 2012/0240794 A1 Sep. 27, 2012

(30) Foreign Application Priority Data

Mar. 22, 2011 (JP) ..... 2011-063290

(51) Int. Cl.
*B65B 13/02* (2006.01)

(52) U.S. Cl.
USPC ..... 100/3; 100/7; 100/8; 100/26; 100/29; 100/33 PB; 53/582; 53/589; 53/540

(58) Field of Classification Search
USPC ..... 100/3, 7, 8, 26, 29, 33 PB; 53/582, 589, 53/540
See application file for complete search history.

(56) References Cited

U.S. PATENT DOCUMENTS

| | | | | |
|---|---|---|---|---|
| 4,424,660 | A | 1/1984 | Sato et al. | |
| 5,092,236 | A * | 3/1992 | Prim et al. | 100/220 |
| 5,172,179 | A * | 12/1992 | Tani et al. | 399/408 |
| 5,468,941 | A * | 11/1995 | Sasaki | 235/379 |
| 6,513,303 | B2 * | 2/2003 | Neri | 53/399 |
| 6,550,621 | B2 * | 4/2003 | Fukatsu et al. | 209/534 |
| 2002/0113366 | A1 * | 8/2002 | Watanabe et al. | 271/315 |
| 2002/0153290 | A1 * | 10/2002 | Otsuka | 209/534 |
| 2005/0060956 | A1 * | 3/2005 | Yui | 53/399 |

FOREIGN PATENT DOCUMENTS

| | | | |
|---|---|---|---|
| CN | 1600644 | A1 | 3/2005 |
| EP | 1219557 | A2 | 12/2001 |
| EP | 1219557 | A3 | 12/2001 |
| EP | 1251072 | A2 | 2/2002 |
| EP | 1251072 | A3 | 2/2002 |
| EP | 1378472 | A1 | 1/2004 |
| EP | 1516818 | A1 | 9/2004 |
| JP | 04-137093 | | 5/1992 |
| JP | 2686068 | | 8/1997 |

OTHER PUBLICATIONS

European Search Report Dated Jul. 18, 2012.

(Continued)

*Primary Examiner* — Shelley Self
*Assistant Examiner* — Onekki Jolly
(74) *Attorney, Agent, or Firm* — Baker Botts L.L.P.

(57) ABSTRACT

According to one embodiment, an accumulating and strapping apparatus includes a first accumulation device configured to accumulate paper sheets, a second accumulation device, a strapping device configured to strap a bundle of the accumulated paper sheets by a tape, a base carrier provided movably up and down among a first position, a second position, and a third position, and a sheet carrier movable on the base carrier. The sheet carrier is configured to receive the accumulated paper sheets from the first accumulation device at the first position of the base carrier, move from a standby position to an advanced position at the third position of the base carrier to transfer the accumulated paper sheets to the strapping device, and move from the standby position to the advanced position at the second position of the base carrier to receive the accumulated paper sheets from the second accumulation device.

9 Claims, 14 Drawing Sheets

(56) References Cited

OTHER PUBLICATIONS

Official Action issued in corresponding Korean Patent Application No. 10-2011-93020, mailed Jul. 30, 2013, 5 pgs (with translation).

Office Action and Search Report issued in related Chinese Patent Application No. 201110272682.8, mailed Feb. 24, 2014, 15 pages (with translation).

* cited by examiner

ACCUMULATING AND STRAPPING APPARATUS

CROSS-REFERENCE TO RELATED APPLICATIONS

This application is based upon and claims the benefit of priority from prior Japanese Patent Application No. 2011-063290, filed Mar. 22, 2011, the entire contents of which are incorporated herein by reference.

FIELD

An embodiment described herein relates generally to an accumulating and strapping apparatus which accumulates and straps paper sheets such as bills and securities.

BACKGROUND

In recent years, large numbers of bills are being handled in banks, major retailers and the like on a daily basis, and a business has been present which classifies and arranges these bills in accordance with money types and wearing states (degrees of damage of the bills). Usually, when the volume of the bills increases, the bills are managed in a state where they are bound with bundling tape every 100 bills. As an apparatus which automates such an arrangement business of the bills, a bill handling apparatus has been suggested. This bill handling apparatus includes a hopper section which stacks and receives unclassified bills, a conveyance mechanism which takes out and conveys the bills one by one from this hopper section, an inspecting section which inspects types and damage degrees of the conveyed bills, a plurality of pocket sections which classify and accumulate the inspected bills in accordance with the money types or the like, and an accumulating and strapping apparatus which straps the accumulated bills, for example, every 100 bills.

The accumulating and strapping apparatus comprises two accumulation devices which accumulate the bills every 100 bills, and a strapping module provided under the accumulation devices. The two accumulation devices are arranged side by side in parallel. Further, the accumulating and strapping apparatus includes a conveyance mechanism which conveys the accumulated bills to the strapping module. This conveyance mechanism is movably up and down provided on each accumulation device, and includes a first carrier which conveys the accumulated bills in upward and downward directions, and second carriers provided movably in a horizontal direction. The second carriers receive a bill bundle from the first carrier, convey and transfer the bundle to the strapping module.

In the accumulating and strapping apparatus constituted as described above, the two accumulation devices are arranged side by side in parallel, and the two second carriers are arranged. Therefore, a large installation space is required, which easily makes the accumulating and strapping apparatus large. Furthermore, the two second carriers and the first carrier independently operate, and hence the operation of the accumulating and strapping apparatus becomes complicated, which impedes speedup.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings. In general, according to one embodiment, an accumulating and strapping apparatus comprises: a first accumulation device configured to accumulate paper sheets every predetermined number thereof in a temporary accumulation unit; a second accumulation device arranged to obliquely shift from the first accumulation device, and configured to accumulate the paper sheets every predetermined number thereof in a temporary accumulation unit; a strapping device configured to strap a bundle of the accumulated paper sheets by a tape; a base carrier provided movably up and down among a first position facing a downside of the first accumulation device, a second position facing a side of the second accumulation device, and a third position facing the strapping device; and a sheet carrier provided on the base carrier movably in a direction intersecting with a moving direction of the base carrier between a standby position located on the base carrier and an advanced position projecting from the base carrier, wherein the sheet carrier is configured to receive the accumulated paper sheets from the first accumulation device at the first position of the base carrier; move from the standby position to the advanced position at the third position of the base carrier to transfer the accumulated paper sheets to the strapping device; and move from the standby position to the advanced position at the second position of the base carrier to receive the accumulated paper sheets from the second accumulation device.

Figure 1:
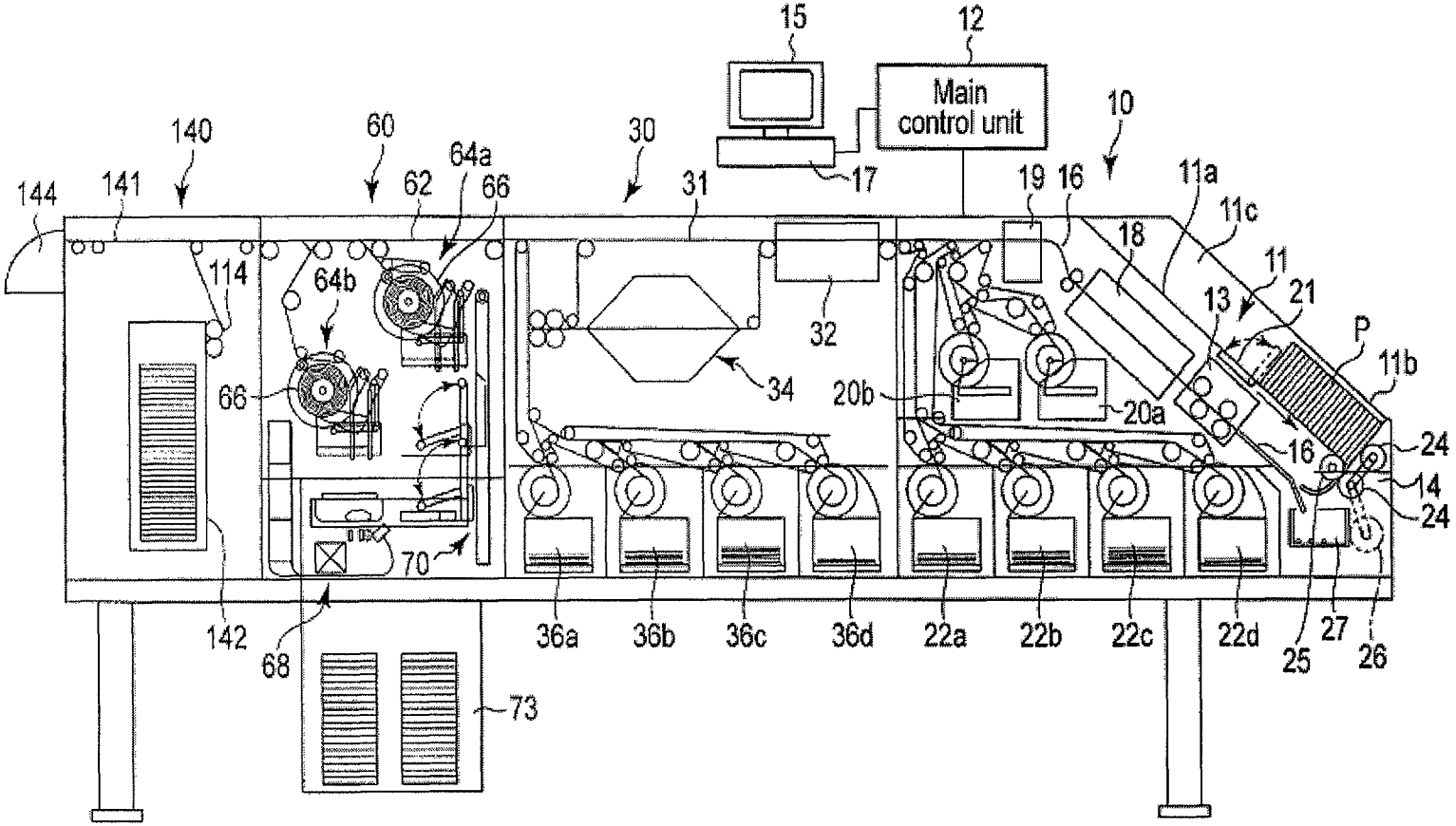
FIG. 1 is a sectional view showing a bill handling apparatus according to a first embodiment.

FIG. 1 is a sectional view schematically showing the whole constitution of a bill handling apparatus according to an embodiment.

As shown in FIG. 1, the bill handling apparatus which handles bills as paper sheets includes a main module 10, an arranging module 30, an accumulating and strapping module 60 which is an accumulating and strapping apparatus, and a large volumetric accumulation module 140. These modules are arranged in a row, and electrically and mechanically interconnected to one another. The main module 10 is provided with a main control unit 12 which controls an operation of the whole apparatus including this main module.

Figure 2:
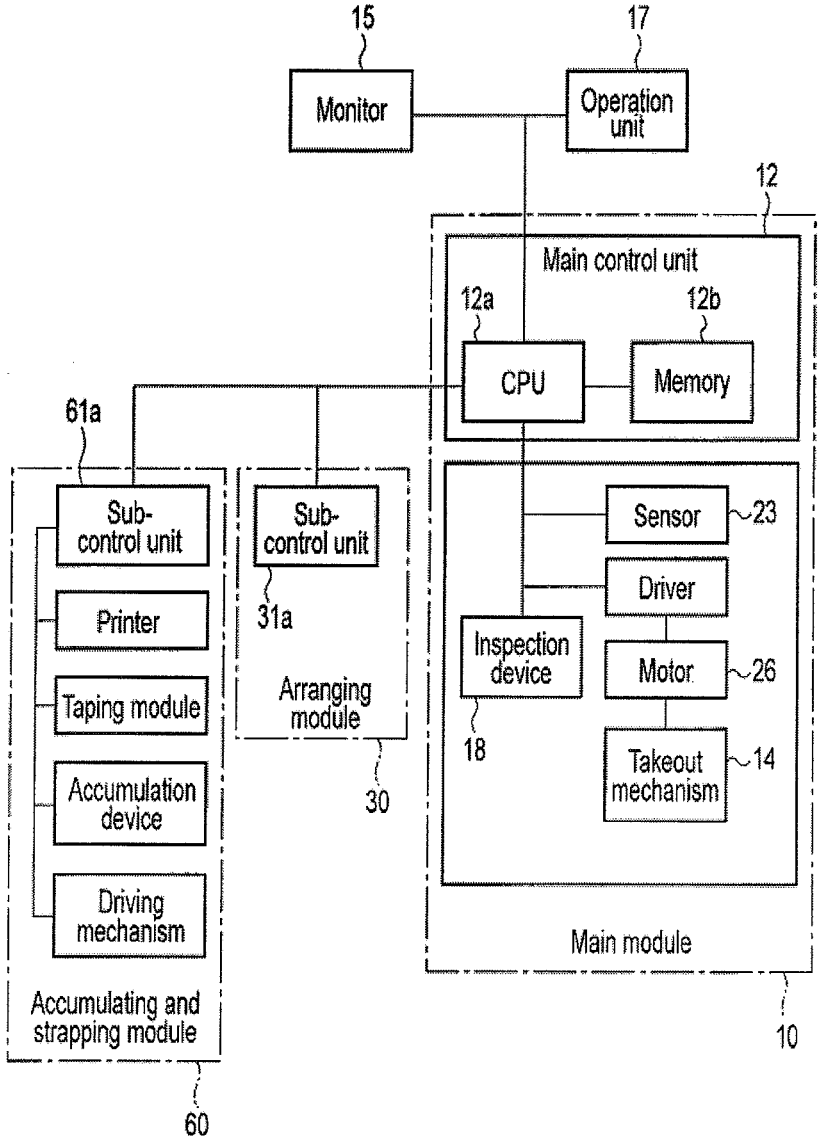
FIG. 2 is a block diagram schematically showing the bill handling apparatus.

As shown in FIG. 1 and FIG. 2, the main control unit 12 is provided in a control board of the main module 10. The main control unit 12 includes a CPU 12*a* which controls the operations of the respective modules and calculates an efficiency of an operation state and the like, and a memory 12*b* which stores various data, control programs, management information and the like. As the various data, there are stored, in the memory 12*b*, printing information printable on bundling tape and including an operator ID, a date/time, a serial number, assignment information, a bank logo, a manager signature image, each country language font and the like which will be described later, processing speeds of a plurality of steps of the paper sheets, and the like.

The main control unit 12 is connected to an operation unit 17 which inputs various pieces of information into the apparatus, and a monitor 15 as a display device which displays input information, an operation state and a processing state of the apparatus and the like. The arranging module 30 and the accumulating and strapping module 60 include sub-control units 31*a* and 61*a* which control the operations of the modules, respectively, and these sub-control units are LAN-connected to the main control unit 12 of the main module 10 via an interface and a cable not shown. The main control unit 12 is connected to a host computer not shown, transmits and receives the information to and from the host computer, and performs the arrangement of the information.

By an operator's operation through the operation unit 17 connected to the main control unit 12, there are performed various operation settings of the handling apparatus, for example, the setting of a transaction method such as a deposit operation or an arranging operation, loading processing into a loading store, inspection processing of the bills in the loading store, the setting of an accumulation store to store handled paper sheets P, the setting of accumulating and strapping processing, and the setting of a wearing level which is a bill judgment level.

Moreover, the main control unit 12 calculates the management information including a processing efficiency of a unit time, a processing efficiency of each of a plurality of days, a processing efficiency of each operator ID, a total number of the handled sheets and a total operation time in accordance with processing information from an inspection device 18 which will be described later, to store the information in the memory 12*b* and to display the information in the monitor 15.

As shown in FIG. 1, the main module 10 includes a supply unit 11 in which a large number of bills P are mounted in a stacked state, a takeout mechanism 14 which takes out the bills P one by one from the supply unit 11, and a conveyance path 16 along which the bills P taken out by the takeout mechanism 14 are conveyed. In the conveyance path 16, a plurality of sets of endless conveyance belts not shown are extended to sandwich the conveyance path. The taken bills P are sandwiched and conveyed by the conveyance belts.

The supply unit 11 includes a support surface 11*a* which tilts as much as an arbitrary angle from a vertical direction and extends, a mounting surface 11*b* which extends from a lower end of the support surface 11*a* in a direction which is substantially orthogonal to the support surface 11*a*, and a pair of guide walls 11*c* vertically disposed along both side edges of the support surface 11*a* and the mounting surface 11*b*. In a boundary portion between the support surface 11*a* and the mounting surface 11*b*, a takeout port is formed to take the bills P in the apparatus. The supply unit 11 is provided on an end side of the device itself of the main module 10, and the lower portion of the supply unit 11, i.e., the mounting surface lib is positioned in the vicinity of the lower end of the device itself.

In the supply unit 11, a plurality of, for example, 2000 or more bills P can be mounted in the stacked state. Of the stacked bills P, the lowermost bill is mounted on the mounting surface 11*b*, and for example, in a state where long-side edges of the bills are mounted on the support surface 11*a*, the bills tilt along the support surface, and are mounted in the supply unit 11. The stacked bills P are taken in the apparatus through the takeout port 11*e* one by one in order from the lowermost bill P by the takeout mechanism 14.

The tilt angle of the support surface 11*a* is set in a range of 25 to 75 degrees, and for example, set in a range of 30 to 40 degrees. It is to be noted that the support surface 11*a* is constituted revolvably with respect to the device itself, and the tilt angle of the support surface may be adjustable.

The supply unit 11 includes a backup plate 21 which moves the stacked bills P toward the takeout side, i.e., the mounting surface 11*b*. The backup plate 21 is provided storably on the support surface 11*a* and movably along the support surface. The backup plate 21 is supported revolvably to the support surface 11*a*. Usually, when, for example, about 2000 bills P are mounted on the supply unit 11, the backup plate 21 is received on a position which becomes about the same surface as the support surface 11*a*, and held at the position by a torsional spring or the like. When the takeout of the bills P advances and the number of the bills decreases to, for example, about 300 bills, the backup plate 21 is revolved to a position where the plate rises from the support surface 11*a* at right angles, and then the backup plate abuts the uppermost bill of the stacked bills P to move to the takeout side together with the stacked bills P. Consequently, the backup plate 21 can move the stacked bills P to the takeout side, and even in a state where the number of the stacked bills P decreases, the falling of the bills or the like is prevented, and the bills can stably be moved to a takeout position.

The takeout mechanism 14 which takes out the bills P one by one from the supply unit 11 includes a plurality of pickup rollers (takeout rollers) 24 provided so that the rollers can abut the bills P on the mounting surface 11*b*, a separation roller 25 provided to rotatably come in contact with the pickup roller 24 on the side of the takeout port lie, and a driving motor 26 which rotates the pickup rollers 24 at a predetermined speed.

When the pickup rollers 24 rotate, the lowermost bill P is taken out by the pickup rollers 24, and fed through the takeout port lie to the conveyance path 16. In this case, by the separation roller 25, the second and subsequent bills P are separated from the taken bill. Consequently, the bills P are taken out of the supply unit 11 one by one and fed to the conveyance path 16.

As shown in FIG. 1, a conveyance pitch correcting section 13 which corrects the conveyance pitch of the bills P conveyed through the conveyance path 16, the inspection device 18 which inspects the bills P one by one at the corrected conveyance pitch, and a barcode reader 19 are arranged along the conveyance path 16. The inspection device 18 is arranged above the takeout port of the supply unit 11 in the vertical direction. The inspection device 18 detects money types, shapes, thicknesses, front or back, authenticities, wearing states, the takeout of double sheets and the like of the conveyed bills P. Here, the wear detection indicates the detection of normal notes which can be re-circulated and worn notes which have dirt, damage and the like and cannot be re-circulated. For example, when a batch card is used, the barcode reader 19 reads the barcode attached to the batch card and a casino chit passed through the inspection device 18, and sends the read information to the main control unit 12.

The conveyance path 16 once extends downwardly from the takeout mechanism 14 and the takeout port, obliquely tilts from the vertical direction, and then extends upwardly from the downside thereof to the inspection device 18. It is noted that the conveyance path 16 is connected to the arranging module 30 which will be described later. According to the present embodiment, the conveyance path 16 tilts and extends substantially along the support surface 11*a* of the supply unit 11, i.e., in the same manner as in the support surface 11*a*. It is to be noted that the conveyance path 16 may immediately extend obliquely upwardly from the takeout port, without once lowering from the takeout port. Moreover, the inspection device 18 is also provided to tilt obliquely along the conveyance path 16. In the lowermost portion of the conveyance path 16, a discharge port is formed, and under the discharge port, a foreign matters collecting box 27 is provided. The foreign matters which drop down along the conveyance path 16 are discharged through the discharge port, and collected in the collection box 27.

As shown in FIG. 1, in the main module 10, two rejecting sections 20*a* and 20*b* are provided along the conveyance path 16, and a plurality of accumulation stores 22*a*, 22*b*, 22*c* and 22*d* in which the bills are accumulated, respectively, are arranged side by side. The bills P passed through the inspection device 18 are sorted into rejected notes and processed notes by a gate not shown. The rejected notes are notes judged to be false notes, or notes judged to be notes which cannot be identified owing to fold, break, skew, the takeout of double sheets, or the like, by the inspection device 18. The skew is a state where the bill P obliquely tilts from a direction which is orthogonal to a conveyance direction. The rejected notes are sorted into the rejecting section 20*a* or 20*b*, and accumulated. The rejected notes accumulated in the rejecting section 20*a* or 20*b*, except the false notes, are set again in the supply unit 11 and taken in the apparatus again, or counted in count data by manual input. Inspection results such as a processed money amount and the number of sheets by the inspection device 18 are sent to the main control unit 12 and stored, and displayed in the monitor 15.

The processed notes indicate that the bills P are judged to be true and normal notes or true and worn notes by the inspection device 18. The processed notes are fed to the accumulation stores 22*a* to 22*d* and accumulated. For example, the processed notes of each money type are sorted and accumulated in any corresponding accumulation store of the accumulation stores 22*a* to 22*d*.

When the batch card is used, the batch card passes through the inspection device 18 and the barcode reader 19, and is then fed to the rejecting section 20*a* or 20*b* and accumulated.

It is to be noted that the main module 10 includes a driving mechanism not shown and a power source not shown to drive the takeout mechanism 14, the inspection device 18, a conveyance mechanism and the like, and additionally includes various sensors.

As shown in FIG. 1, the arranging module 30 includes a conveyance path 31 along which the bills P fed from the main module 10 are conveyed, an arranging mechanism 32 provided on an upstream side of the conveyance path 31, an inverting device 34 provided along the conveyance path 31 on a downstream side of the arranging mechanism 32, and a plurality of accumulation stores 36*a*, 36*b*, 36*c* and 36*d* arranged side by side along the conveyance path 31.

The arranging mechanism 32 aligns the center of each of the bills P conveyed through the conveyance path 31 with the center of the conveyance path 31, and corrects each skewed bill so that one side of the bill is directed orthogonally to the conveyance direction. The inverting device 34 inverts the bills P conveyed through the conveyance path 31, to align front and back directions of the bills in arbitrarily designated directions, thereby feeding out the bills.

The bills P fed out of the arranging mechanism 32 or the bills P having aligned directions and fed out of the inverting device 34 are conveyed through the conveyance path 31 to the accumulating and strapping module 60, or fed to any of the accumulation stores 36*a* to 36*d* and accumulated. The accumulation stores 36*a* to 36*d* of the arranging module 30 can be used as accumulation stores which accumulate the bills of each money type, or can be used as rejected note stores or worn note stores which accumulate the rejected notes or the worn notes taken out of the main module 10.

On the other hand, when the strapping processing of the bills is set, the normal notes or the worn notes taken out of the main module 10 or the normal notes or the worn notes taken out of the arranging module 30 are conveyed through the conveyance path 31 of the arranging module 30 to the strapping module 60, and the notes are accumulated and strapped every predetermined number thereof. In this case, the arranging module 30 aligns the center of each bill conveyed through the conveyance path 31 with the center of the conveyance path, and corrects each skewed bill so that one side of the bill is directed orthogonally to the conveyance direction. When the arranging module 30 arranges a positional relation between the bills to be strapped, the accumulating and strapping module 60 can orderly accumulate and strap the bills.

Figure 3:
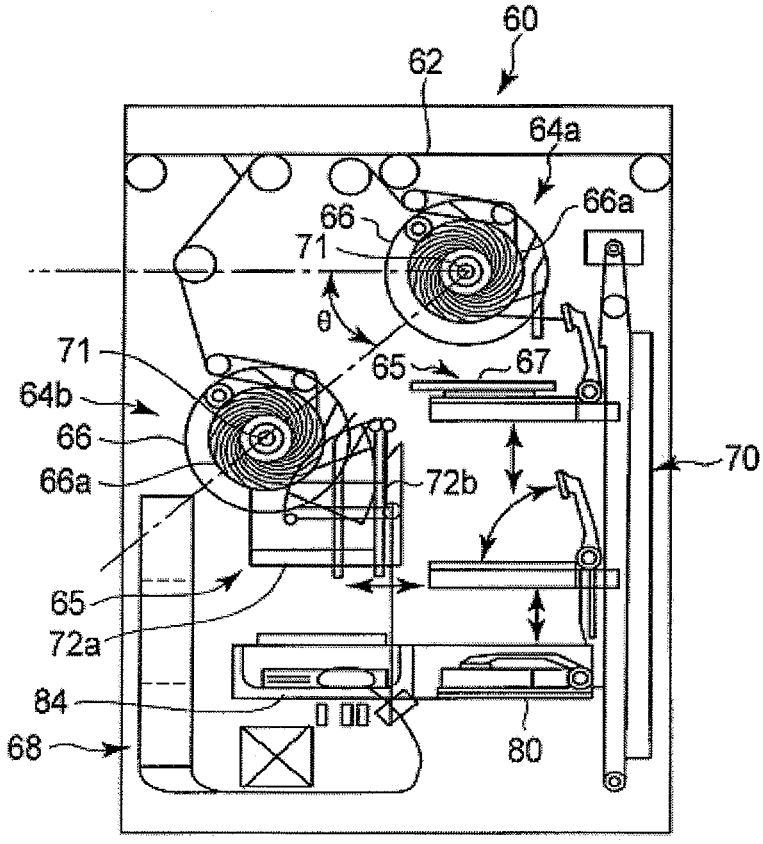
FIG. 3 is a sectional view showing an accumulating and strapping module of the bill handling apparatus.
Figure 4B:
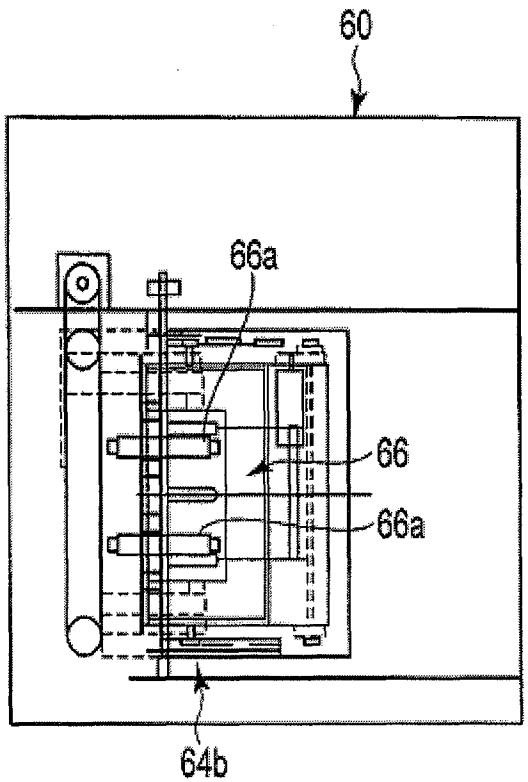
FIG. 4B is a plan view showing a second accumulation device of the accumulating and strapping module.
Figure 4A:
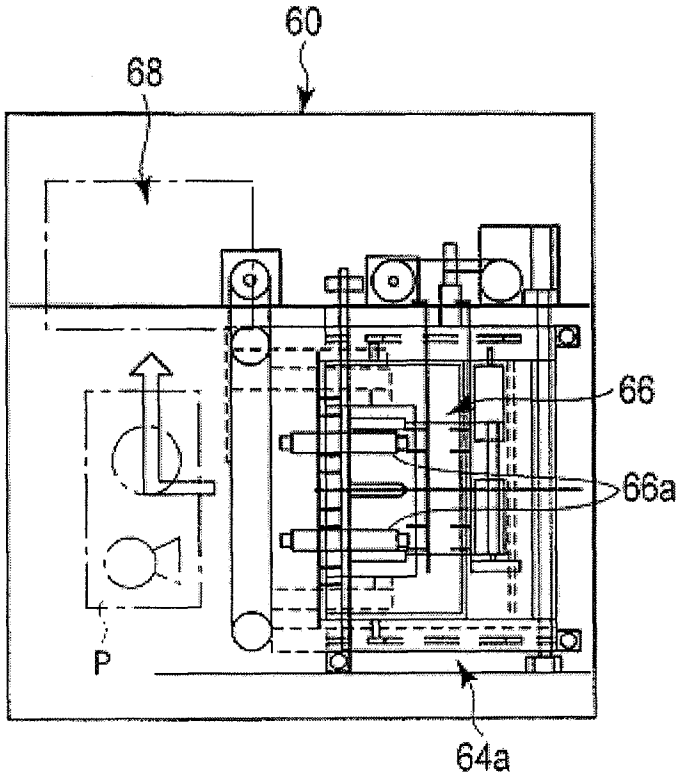
FIG. 4A is a plan view showing a first accumulation device of the accumulating and strapping module.

FIG. 3 and FIG. 4 are a front view and a plan view of the accumulating and strapping module 60 which is an accumulating and strapping apparatus. As shown in FIG. 1, FIG. 3 and FIG. 4, the strapping module 60 includes a conveyance path 62 which communicates with the conveyance path 31 of the arranging module 30; a first accumulation device 64*a* and a second accumulation device 64*b* which accumulate the bills conveyed through the conveyance path 62 every predetermined number thereof; a strapping device 68 which straps, with tape, each bundle of the predetermined number of bills, for example, 100 bills accumulated by these accumulation devices; and a conveyance mechanism 70 which conveys, to the strapping device 68, the bundles of the bills accumulated by the first accumulation device 64*a* and the second accumulation device 64*b*. Furthermore, a discharge section 73 which receives and accumulates the bill bundles strapped by the strapping device 68 is provided under the strapping device 68.

The first accumulation device 64*a* and the second accumulation device 64*b* are arranged to shift from each other in an upward-downward direction and a right-left direction. The second accumulation device 64*b* is arranged to obliquely shift as much as, for example, an angle θ of about ten to 80 degrees from the first accumulation device 64*a* in the downward direction, and the device is arranged so that part thereof overlaps with the first accumulation device 64*a* in the vertical direction. The strapping device 68 is arranged under the second accumulation device 64*b*.

Each of the first and second accumulation devices 64*a* and 64*b* includes a temporary accumulation unit 65, and an impeller accumulation device 66 which accumulates the fed bills P one by one every predetermined number thereof in the temporary accumulation unit 65. An impeller 66*a* of the impeller accumulation device 66 has a plurality of blades incorporated around a rotary shaft, and is rotated synchronously with the conveyance of the bills P so that each conveyed bill P is received between the blades. By using the impeller 66*a*, the bills P are accumulated in the temporary accumulation unit 65 while absorbing movement energy of the bills P conveyed at a high speed and while aligning the bills P.

The temporary accumulation unit 65 of the first accumulation device 64*a* includes, for example, a first shutter 67 which is openable/closable in a horizontal direction, and the bills P are accumulated on the first shutter 67 which is at a closed position. The temporary accumulation unit 65 of the second accumulation device 64*b* includes a horizontal support base 72*a* on which the bills P are accumulated, and a second shutter 72*b* which abuts long sides of the accumulated bills to align the bills at positions thereof in a width direction. The second shutter 72*b* is provided revolvably between an alignment position where the bills P are aligned and an open position where the passage of the stacked bill bundles is allowed.

Moreover, the first accumulation device 64*a* and the second accumulation device 64*b* are provided with display units 71 such as LEDs which display accumulation device errors, device processing states such as coefficient states, and the like, respectively. The display units 71 are provided at positions such that, for example, when an outer cover of the accumulating and strapping module 60 is opened, the display units can easily visually be recognized from the outside. The display units 71 display various processing states of the accumulation devices by blinking, lighting or extinguishing or in different colors so that an operator can judge the states, for example, whether or not it is necessary to supply the bills again, whether or not the errors have been generated, and whether or not the bills are verified.

Figure 5:
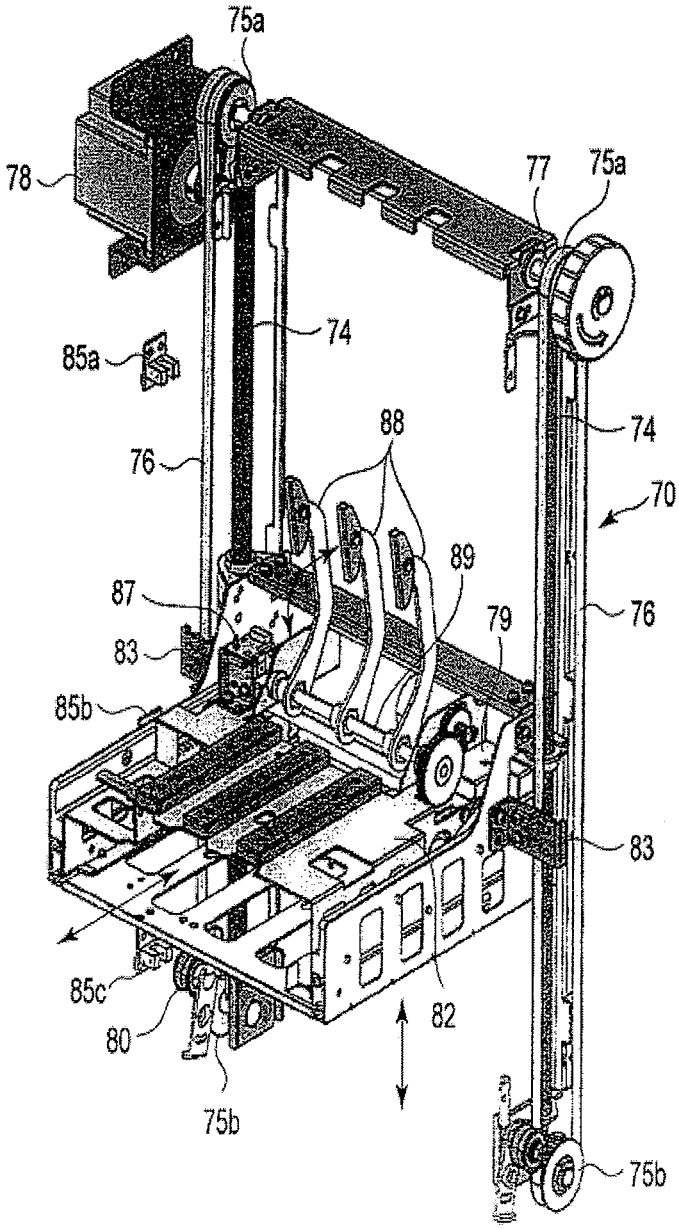
FIG. 5 is a perspective view showing a conveyance mechanism in the accumulating and strapping module.

The conveyance mechanism 70 which conveys the bill bundle between the first accumulation device 64*a* or the second accumulation device 64*b* and the strapping device 68 includes, as shown in FIG. 3 and FIG. 5, a pair of guide rods 74 raised along the vertical direction; pulleys 75*a* and 75*b* provided at upper and lower ends of the respective guide rods; driving belts 76 extended around the pulleys 75*a* and 75*b* to extend in the vertical direction; an interconnection shaft 77 which interconnects the two pulleys 75*a* at the upper ends; a motor 78 which drives one of the pulleys 75*a* on an upper end side to run the pair of driving belts 76 in the upward-downward direction; a base carrier 80 which is movable up and down along the guide rods 74; and a sheet carrier (a conveyance tray) 82 provided on the base carrier 80 reciprocatably along the horizontal direction.

The sheet carrier 82 is formed into a substantially rectangular dish-like shape, has one end thereof supported by the pair of guide rods 74, and guided movably up and down along these guide rods. The base carrier 80 substantially horizontally extends. Moreover, the base carrier 80 is interconnected to the driving belts 76 via a pair of brackets 83. When the motor 78 is rotated forwards or backwards and driven, the driving belts 76 run in the upward-downward direction, and the base carrier 80 is moved up and down by the driving belts 76. The base carrier 80 is moved up and down among a first position located adjacent to the first shutter 67 of the first accumulation device 64*a* to face the downside of the shutter, a second position facing a side of the support base 72*a* of the second accumulation device 64*b*, and a third position facing a side of a support table 84 of the strapping device 68 which will be described later. At the respective positions, position sensors such as photo-interrupters 85*a*, 85*b* and 85*c* are provided. When these position sensors detect the base carrier 80, the base carrier 80 can be moved to any of these positions and positioned.

On the other hand, the sheet carrier 82 is formed into, for example, a rectangular plate-like shape having a dimension which is larger than each of the bills P, and on the sheet carrier, the accumulated bills can be mounted. The sheet carrier is provided on the base carrier 80 reciprocatably along the horizontal direction. That is, the sheet carrier 82 is provided on the base carrier 80 to be reciprocatable along a direction intersecting with a moving direction of the base carrier 80, i.e., the horizontal direction here, between a standby position shown in FIG. 5 where the sheet carrier is positioned to be superimposed on the base carrier 80 and an advanced position where the sheet carrier extends, from a front end thereof, substantially horizontally from the base carrier. On the base carrier 80, there is provided a driving source 87 such as a motor or a plunger which moves the sheet carrier 82 in the horizontal direction.

The sheet carrier 82 is provided with a plurality of bill clampers 88 which hold the bill bundles on the sheet carrier. The bill clampers 88 are attached to a rotary shaft 89 supported by the sheet carrier 82. When the rotary shaft 89 is revolved by a driving motor 79 provided on the sheet carrier 82, the bill clampers are revolved between an open position where the clampers are arranged away from the support surface of the sheet carrier 82 and a clamp position where the clampers press the bill bundle from the upside thereof onto the sheet carrier 82 to clamp and hold the bill bundle, as shown in FIG. 5.

Figure 6:
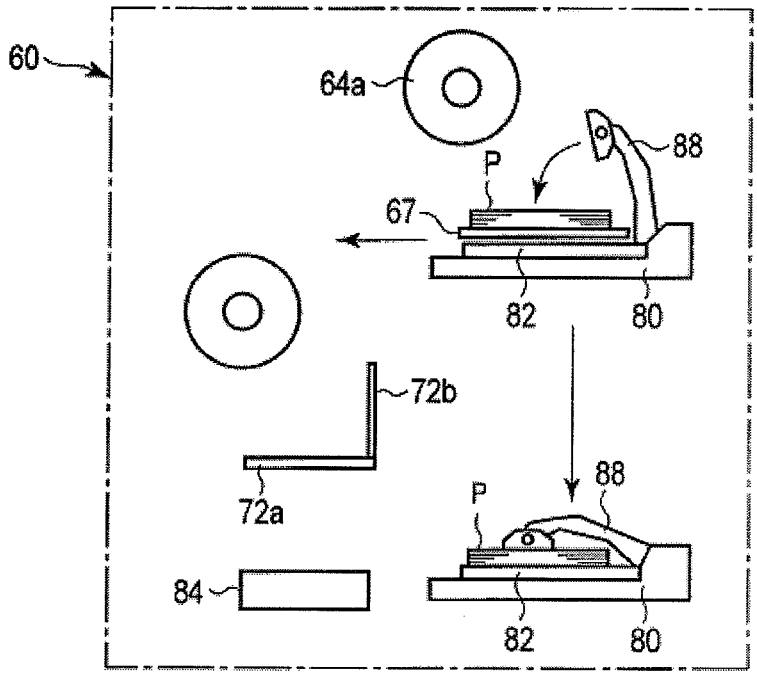
FIG. 6 is a view schematically showing a first operation state of the conveyance mechanism.

The accumulation of the bills by the first and second accumulation devices 64*a* and 64*b* and the conveyance of the bill bundles by the conveyance mechanism 70 are performed as follows. As shown in FIG. 6, the predetermined number of the bills, for example, 100 bills of the same note type are accumulated on the first shutter 67 by the first accumulation device 64*a*. During the accumulation, the base carrier 80 is on standby at the first position, and the sheet carrier 82 on the base carrier 80 is arranged adjacent to the first shutter 67 to face the downside of the shutter. When 100 bills P are accumulated on the first shutter 67, the first shutter 67 moves to the open position, and the accumulated bills P are mounted on the sheet carrier 82. Next, the bill clampers 88 press the accumulated bills to hold the accumulated bills on the sheet carrier 82, and then the base carrier 80 is lowered to the third position. Afterward, the first shutter 67 is returned to the original accumulating position.

Figure 7:
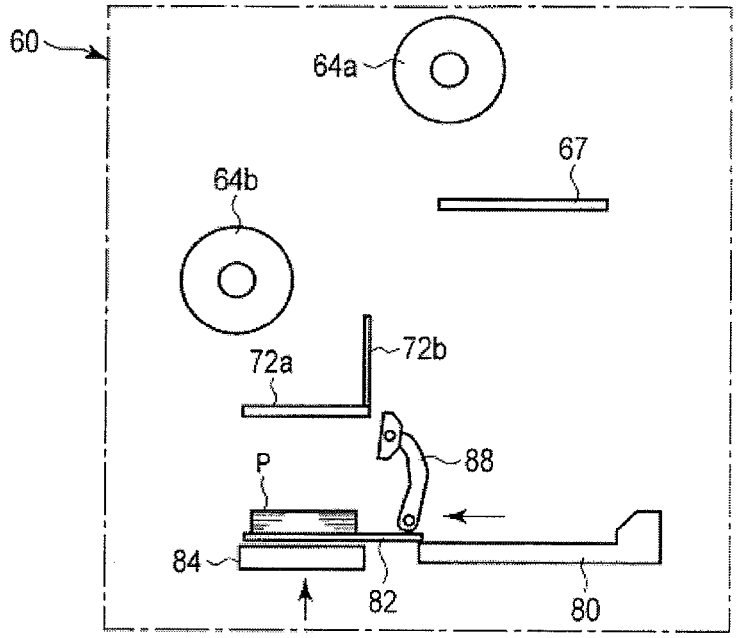
FIG. 7 is a view schematically showing a second operation state of the conveyance mechanism.

Next, as shown in FIG. 7, the sheet carrier 82 advances from the standby position to the advanced position, to carry the accumulated bills onto the support table 84 of the strapping device. Next, one end of each of the accumulated bills in a longitudinal direction is clutched by a clutching/drawing mechanism of the strapping device 68 which will be described later. Moreover, the bill clampers 88 are opened to release the held bills, and then the sheet carrier 82 is moved from the advanced position to the standby position. When the sheet carrier 82 moves to the standby position, the support table on standby at a downside position moves up, and the clutching/drawing mechanism supports the clutched accumulated bills P on the support table 84. Consequently, the accumulated bills P are transferred to the strapping device 68.

Figure 8:
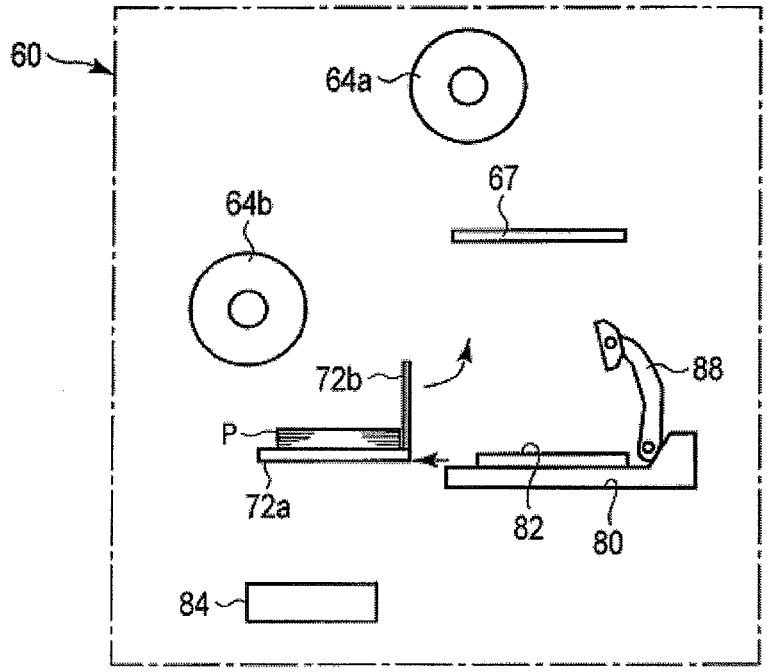
FIG. 8 is a view schematically showing a third operation state of the conveyance mechanism.
Figure 9:
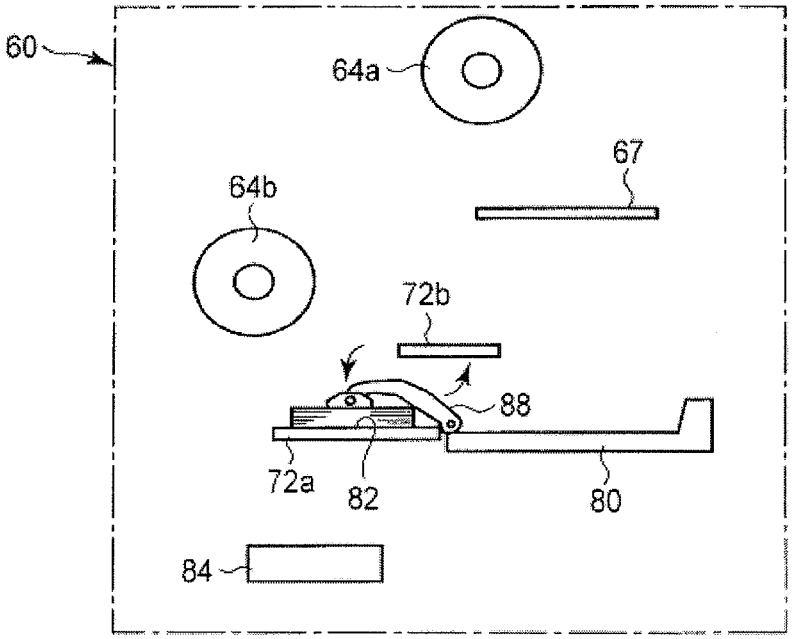
FIG. 9 is a view schematically showing a fourth operation state of the conveyance mechanism.

On the other hand, after the first accumulation device 64*a* accumulates 100 bills, the 101-st and subsequent bills are fed to the second accumulation device 64*b*, and as shown in FIG. 8, the second accumulation device 64*b* accumulates the predetermined number of the bills, for example, 100 bills on the support base 72*a*. During the accumulation, the second shutter 72*b* is present at a shown alignment position, and aligns the accumulated bills at positions thereof in the width direction. Moreover, the base carrier 80 is on standby at the second position, and faces the side of the support base 72*a*. When 100 bills P are accumulated on the support base 72*a*, the sheet carrier 82 advances from the standby position to the advanced position, moves into the support base 72*a* in a nested state, and is positioned under the accumulated bills P. Next, as shown in FIG. 9, the second shutter 72*b* revolves to the open position, and allows the passage of the accumulated bills P.

Figure 10:
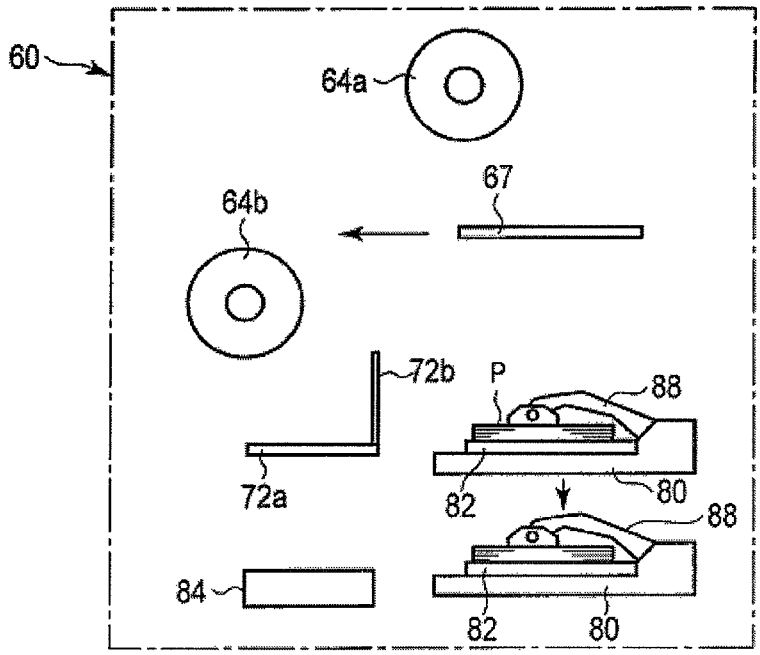
FIG. 10 is a view schematically showing a fifth operation state of the conveyance mechanism.

In this state, the bill clampers 88 press the accumulated bills P to hold the accumulated bills on the sheet carrier 82. Afterward, as shown in FIG. 10, the sheet carrier 82 is returned to the standby position, and the sheet carrier and the accumulated bills P are moved onto the base carrier 80. Next, the sheet carrier 82 and the base carrier 80 are lowered to the third position. The second shutter 72*b* is returned to the original alignment position.

Figure 11:
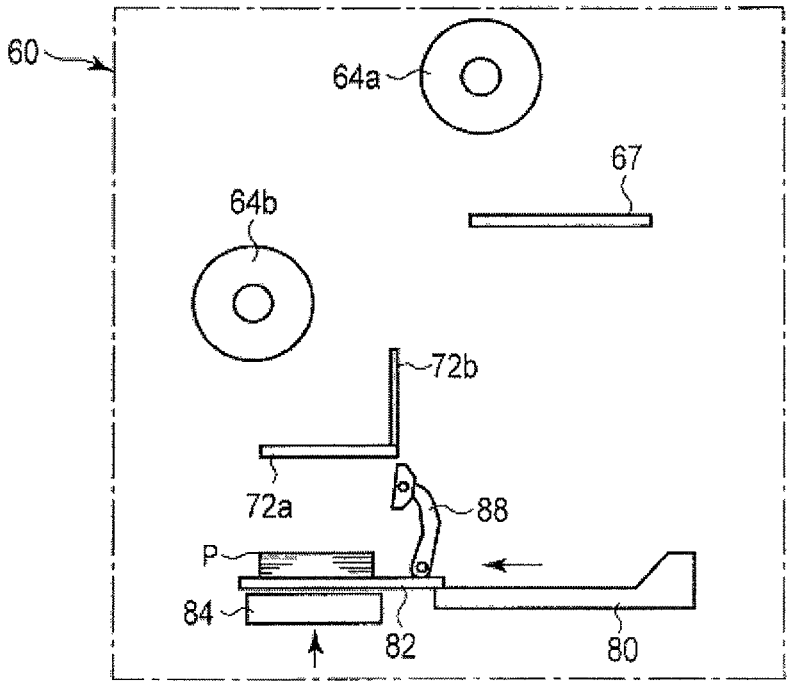
FIG. 11 is a view schematically showing a sixth operation state of the conveyance mechanism.

Next, as shown in FIG. 11, when the base carrier is at the third position, the sheet carrier 82 advances from the standby position to the advanced position, and carries the accumulated bills onto the support table 84 of the strapping device. Next, the clutching/drawing mechanism of the strapping device 68 which will be described later clutches one end of each of the accumulated bills longitudinally. Moreover, the bill clampers 88 are opened to release the held bills. Afterward, the sheet carrier 82 is moved from the advanced position to the standby position. When the sheet carrier 82 moves to the standby position, the support table on standby at the downside position moves up, to support the accumulated bills P clutched by the clutching/drawing mechanism on the support table 84. Consequently, the accumulated bills P are transferred to the strapping device 68.

Figure 12:
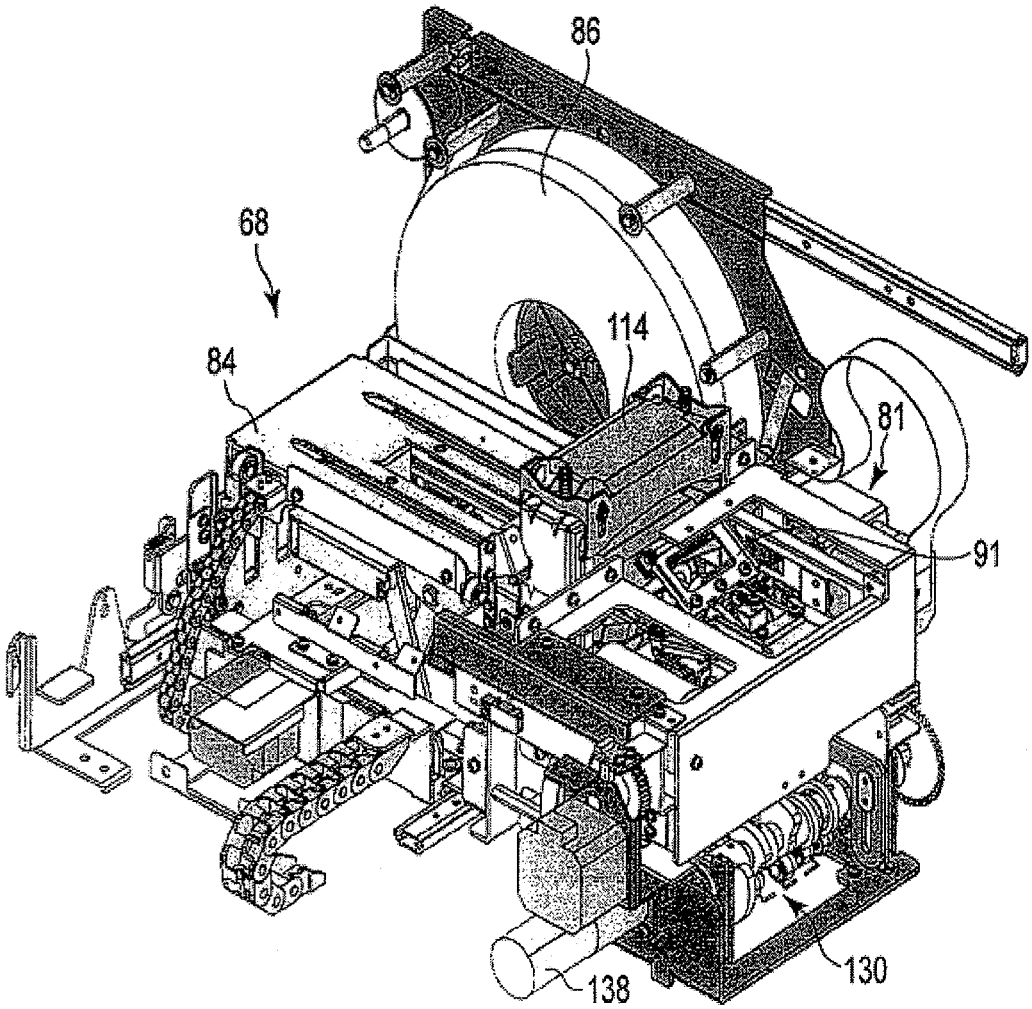
FIG. 12 is a perspective view showing a strapping device in the accumulating and strapping module.
Figure 13:
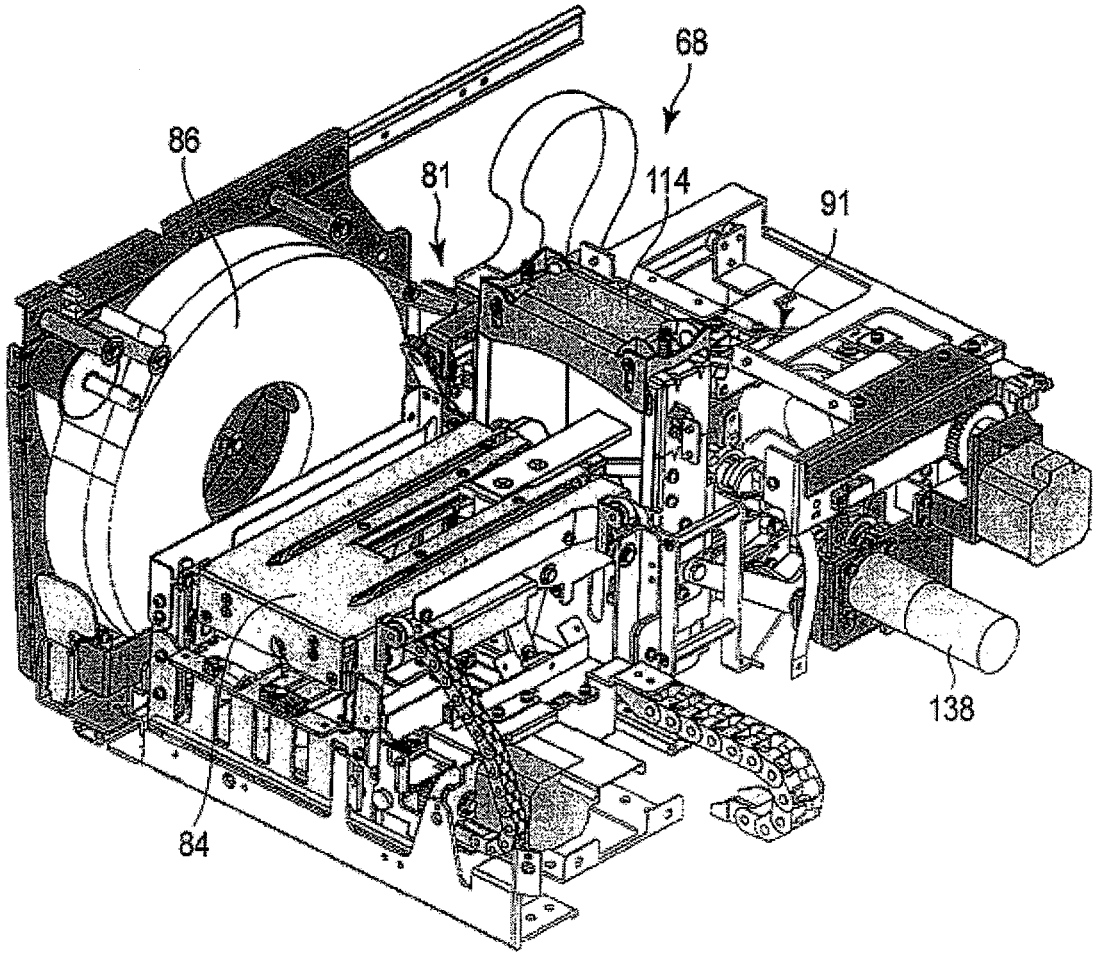
FIG. 13 is a perspective view showing a strapping device seen from a different direction.
Figure 17:
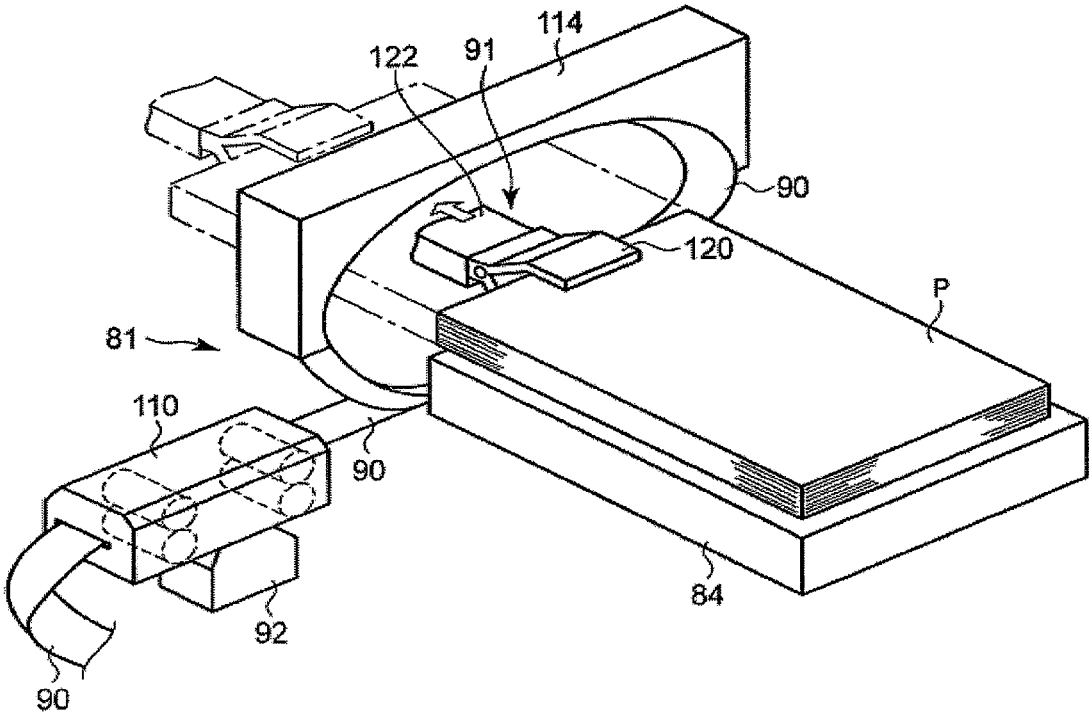
FIG. 17 is a perspective view schematically showing the strapping device during a strapping operation.

Next, the strapping device 68 will be described. As shown in FIG. 12, FIG. 13 and FIG. 17, the strapping device 68 includes a substantially rectangular support table (bed) 84 on which the above-mentioned accumulated bills P are mounted; a tape reel 86 around which a binding tape for strapping each bill bundle is wound; a tape feed mechanism 81 which draws out a binding tape 90 from the tape reel 86 to feed out the tape in the form of a loop; a clutching/drawing mechanism 91 which clutches the ends of the accumulated bills P to draw in the accumulated bills through the loop-like binding tape 90; and a printer 92 which prints desirable printing information on the binding tape 90.

Figure 14:
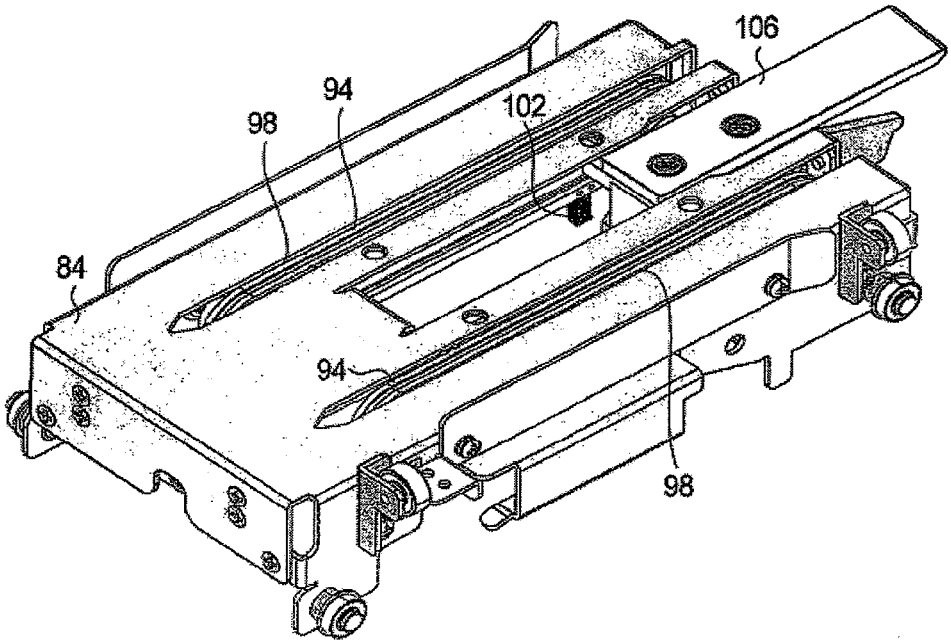
FIG. 14 is a perspective view showing a support table of the strapping device.
Figure 15:
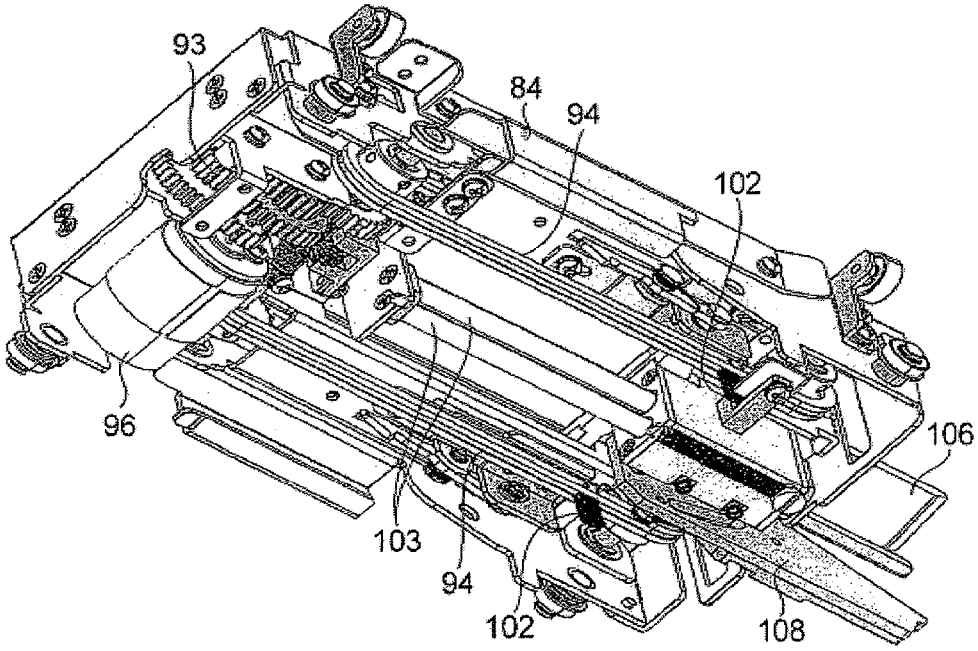
FIG. 15 is a perspective view showing a backside of the support table.
Figure 20:
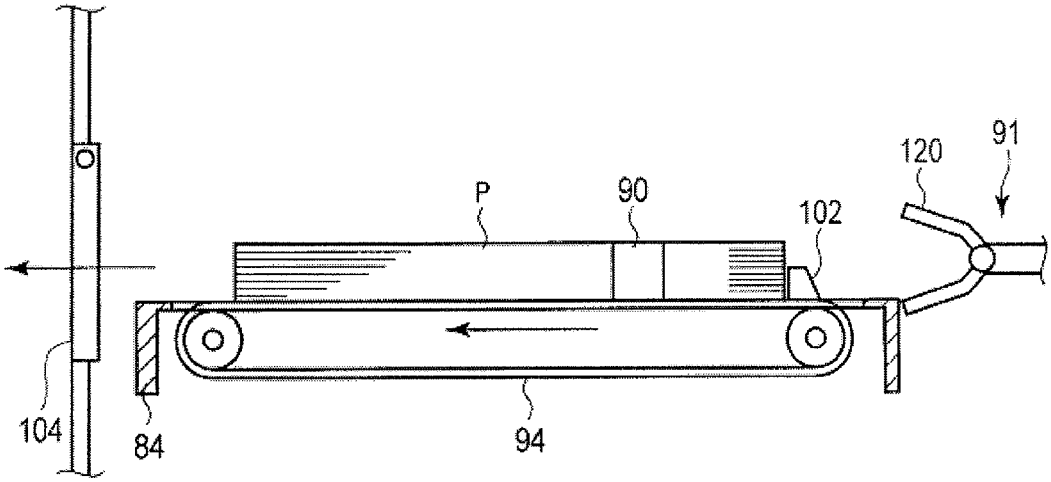
FIG. 20 is a sectional view showing the support table.

The support table 84 is movably up and down provided. As shown in FIG. 13 to FIG. 15, a discharge mechanism which discharges the strapped bill bundle from the support table 84 through a discharge port is provided on the backside of the support table. This discharge mechanism includes two feed belts 94 provided on the backside of the support table 84, a plurality of pulleys 95 around which the feed belts 94 are extended, and a driving motor 96 which drives the pulleys 95 via a train of gears 93 to run the feed belts 94. In the upper surface of the support table 84, a pair of slits 98 extending longitudinally are formed, and part of the feed belts 94 is exposed on the side of the upper surface of the support table 84 via the slits 98. To each of the feed belts 94, a claw-like pressing member 102 is attached. When the feed belts 94 are run, the pressing members 102 run along the surface of the support table 84 along a discharge direction. As shown in FIG. 20, when each of the feed belts 94 is run in a state where the strapped bill bundle P is mounted on the support table 84, the pressing member 102 abuts the rear end of the bill bundle, to push out the bill bundle P in the discharge direction. Consequently, the strapped bill bundle P is discharged through a discharge port 104 of the accumulating and strapping apparatus 60 to the outside.

Moreover, as shown in FIG. 14 and FIG. 15, an elongated rectangular plate-like ironing pad 106 is provided on the support table 84. The ironing pad 106 is supported reciprocatably longitudinally relative to the support table 84 by guide rails 103 provided on the backside of the support table 84, and the ironing pad can project from the support table 84 to the rear side thereof. Moreover, a cutter 108 which cuts the binding tape 90 is provided on the backside of the support table 84. The cutter 108 is supported reciprocatably together with the ironing pad 106.

As shown in FIG. 12, FIG. 13, FIG. 16, FIG. 17 and FIG. 18, the tape feed mechanism 81 includes a tape feeder 110 which feeds out the binding tape 90 to the rear of the support table 84, a tape catcher 112 which clutches the tip of the binding tape 90 to rotate the tape, and a tape guide 114 which guides the fed binding tape 90 in the form of the loop.

Figure 18:
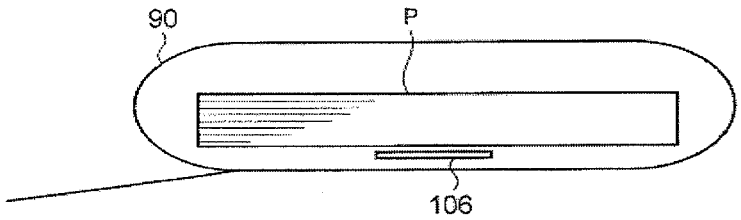
FIG. 18 is a view schematically showing a bill bundle and tape during the strapping operation.

The printer 92 prints the desirable information on the binding tape 90. Afterward, the tape feed mechanism 81 clutches the tip of the binding tape 90 drawn out of the tape reel 86 with the tape catcher 112, and the binding tape 90 in a rotated state is fed out to a binding position behind the support table 84 by the tape feeder 110. Furthermore, when the binding tape 90 is fed out along the tape guide 114, the binding tape wound in the form of the loop is supplied to the rear of the support table 84. Then, by the clutching/drawing mechanism 91 which will be described later, the accumulated bills P are passed through the loop of the binding tape 90 and moved to the binding position. Afterward, the tape feed mechanism 81 draws back the binding tape 90, to tape the accumulated bills P with the binding tape 90. In this case, as shown in FIG. 18, the ironing pad 106 is sandwiched between the accumulated bills P and the binding tape 90 to tape the bundle with the binding tape.

It is to be noted that the printer 92 prints, on the binding tape 90, information stored in the main control unit 12, for example, the operator ID, the date/time, the serial number, the assignment information, the bank logo, the manager signature image and the like in a desirable language font.

As shown in FIG. 12, FIG. 13 and FIG. 17, the clutching/drawing mechanism 91 includes an openable/closable claw 120 which clutches the ends of the accumulated bills P, a movable arm 122 connected to the claw 120 reciprocatably along a direction which is substantially parallel to the surface of the support table 84, and a driving mechanism which opens/closes the claw 120 and drives the movable arm. Moreover, the clutching/drawing mechanism 91 clutches, with the claw 120, the accumulated bills P conveyed by the sheet carrier of the above-mentioned conveyance mechanism, to support the bills on the support table 84.

Furthermore, after the loop of the binding tape 90 is made, the clutching/drawing mechanism 91 passes the clutched accumulated bills P through the loop of the binding tape 90 to draw in the bills to the binding position behind the support table 84. It is to be noted that synchronously when the accumulated bills P are drawn in, the ironing pad 106 and the cutter 108 of the support table 84 are moved to a binding position side, the ironing pad 106 is interposed between the accumulated bills and the binding tape 90, and the cutter 108 is set to a position where the end of the binding tape is held.

After the accumulated bills P are strapped with the binding tape 90, the clutching/drawing mechanism 91 pushes out the bill bundle P onto the support table 84, and opens the claw 120 to release the clutched bundle.

Figure 19:
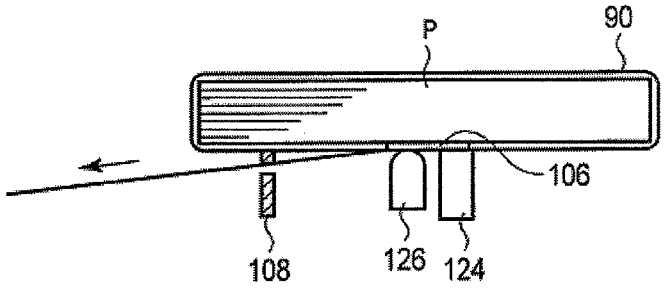
FIG. 19 is a view schematically showing the bill bundle, the bundling tape, and a cutter and a heater of the strapping device.

As shown in FIG. 19, the strapping device 68 includes a tape clamp 124 which sandwiches a binding end of the binding tape 90 of the accumulated bills P between the clamp and the ironing pad 106, and a heater 126 which abuts the ironing pad 106 while sandwiching this binding end between the ironing pad and the heater, to heat and seal the binding end. The tape clamp 124 and the heater 126 are provided movably up and down between a position abutting the binding tape 90 and a position away from the binding tape.

Moreover, the cutter 108 described above is arranged at a position where a terminal end of the wound binding tape 90 is held, and the cutter is driven by a driving mechanism which will be described later, to cut the binding tape 90.

Figure 16:
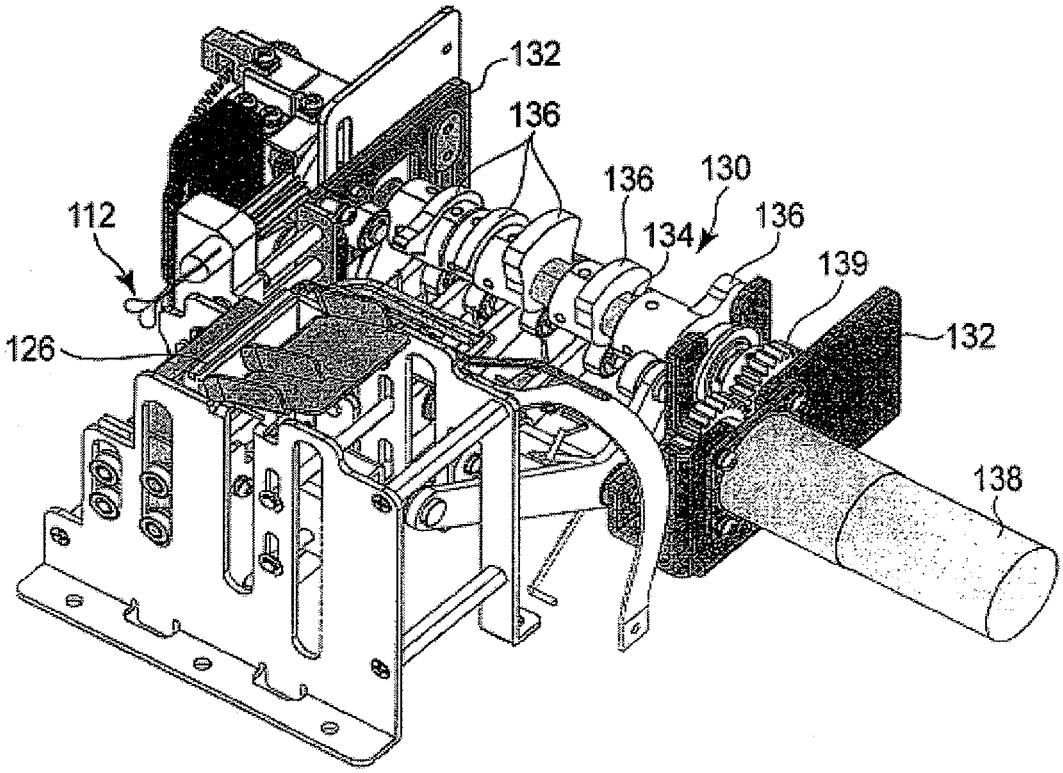
FIG. 16 is a perspective view showing a drive mechanism of the strapping device.

As shown in FIG. 12, FIG. 13 and FIG. 16, the strapping device 68 includes a driving mechanism 130 which synchronously drives the respective function elements described above. The driving mechanism 130 includes a drive shaft 134 rotatably supported by a support frame 132 provided behind and under a strapping position, to extend substantially horizontally, a plurality of cams 136 fixed to this drive shaft, and a motor 138 which rotates the drive shaft 134 via a gear train 139. The plurality of cams 136 are arranged side by side along an axial direction of the drive shaft 134, with predetermined directions, respectively. The tape catcher 112, the cutter 108, the tape clamp 124 and the heater 126 described above engage with the corresponding cam 136 via an operation arm, an operation rod or the like. Moreover, when the motor 138 rotates the drive shaft 134, the plurality of cams 136 synchronously drive the tape catcher 112, the cutter 108, the tape clamp 124 and the heater 126 at desirable timings, respectively.

As described above, the accumulating and strapping module 60 accumulates and straps the normal notes or the worn notes fed from the main module 10 and the arranging module 30 for each money type, or accumulates and straps the worn notes or the normal notes every predetermined number thereof, to supply the bill bundle (bunch). The strapped bill bundles are discharged to the discharge section 73 provided under the accumulation module, and sequentially accumulated and received.

As shown in FIG. 1, the large volumetric accumulation module 140 provided on a downstream side of the accumulating and strapping module 60 includes a conveyance path 141 along which the bills P fed from the accumulating and strapping module 60 are conveyed, and a large volumetric accumulation store 142 which can accumulate a predetermined number of the bills conveyed through the conveyance path 141.

On the most downstream side of all the modules, a safety pocket 144 is provided. When there is a bill which cannot be handled during the conveyance through all the modules, this bill is discharged to the safety pocket 144 and removed from the apparatus.

According to the bill handling apparatus constituted as described above, the paper sheets can stably be taken out and handled, which can enhance reliability. Moreover, in the accumulating and strapping apparatus, the first and second accumulation devices are arranged to obliquely shift from each other, and the bills accumulated by the first and second accumulation devices are conveyed to the strapping device by the common conveyance mechanism, whereby the space saving of the accumulating and strapping apparatus can be achieved, and miniaturization thereof can be realized. Moreover, in the accumulating and strapping apparatus, speedup of the accumulating and strapping processing can be achieved, and one bill bundle can be strapped in, for example, 6 seconds or less. Consequently, according to the present embodiment, there can be provided the accumulating and strapping apparatus which enables miniaturization and speedup of processing.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, the paper sheets to be handled are not limited to the bills and batch cards, and the present invention may be applied to paper sheets such as casino chits and securities. Moreover, in the bill handling apparatus, the number of the accumulating and strapping modules is not limited to one, and a plurality of accumulating and strapping modules may be provided side by side.

What is claimed is:

1. An accumulating and strapping apparatus comprising:

a first accumulation device comprising a first temporary accumulation unit and a first impeller accumulation device configured to accumulate paper sheets every predetermined number thereof in the first temporary accumulation unit;

a second accumulation device arranged to obliquely shift from the first accumulation device, the second accumulation device comprising a second temporary accumulation unit and a second impeller accumulation device configured to accumulate the paper sheets every predetermined number thereof in the second temporary accumulation unit;

a strapping device configured to strap a bundle of the accumulated paper sheets by a tape;

a base carrier provided movably up and down among a first position facing a downside of the first accumulation device, a second position facing a side of the second accumulation device, and a third position facing the strapping device; and a sheet carrier provided on the base carrier movably in a direction intersecting with a moving direction of the base carrier between a standby position located on the base carrier and an advanced position projecting from the base carrier, wherein the sheet carrier is configured to receive the accumulated paper sheets from the first accumulation device at the first position of the base carrier; move from the standby position to the advanced position at the third position of the base carrier to transfer the accumulated paper sheets to the strapping device; and move from the standby position to the advanced position at the second position of the base carrier to receive the accumulated paper sheets from the second accumulation device.

2. The accumulating and strapping apparatus according to claim 1, wherein the first temporary accumulation unit of the first accumulation device comprises a first shutter on which the paper sheets are accumulated, and the first shutter is configured to open so that the accumulated paper sheets are transferred onto the sheet carrier, when the base carrier is moved to the first position.

3. The accumulating and strapping apparatus according to claim 2, wherein the second accumulation device comprises a second shutter movable between an alignment position wherein the second shutter abuts long sides of the paper sheets accumulated in the second temporary accumulation unit, to align the accumulated paper sheets, and an open position wherein the second shutter allows a passage of the sheet carrier.

4. The accumulating and strapping apparatus according to claim 1, wherein the strapping device comprises a support table configured to support the accumulated paper sheets, a tape feed mechanism configured to feed out the tape in a form of a loop, and a clutching/drawing mechanism configured to clutch the accumulated paper sheets and draw the accumulated paper sheets through the loop-shaped tape.

5. The accumulating and strapping apparatus according to claim 4, wherein the strapping device comprises a discharge mechanism including a feed belt supported by the support table, a pressing member attached to the feed belt and configured to abut ends of the accumulated paper sheets mounted on the support table, and a driving section configured to run the feed belt, and the discharge mechanism is configured to discharge, from the support table, the strapped accumulated paper sheets on the support table.

6. The accumulating and strapping apparatus according to claim 5, wherein the strapping device comprises a cutter provided on the support table to cut the tape, a tape clamper movable between an abutment position to press the tape and a position away from the tape, and a tape catcher configured to clutch and rotate a tip of the tape, when the tape is fed out.

7. The accumulating and strapping apparatus according to claim 6, wherein the strapping device comprises a driving mechanism including a rotary shaft, a plurality of cams attached to the rotary shaft and arranged side by side in an axial direction, and a motor configured to rotate the rotary shaft, and the driving mechanism is configured to synchronously drive the cutter, the tape catcher, and the tape clamper by the plurality of cams.

8. The accumulating and strapping apparatus according to claim 1, further comprising a display configured to display processing states of the first accumulation device and the second accumulation device.

9. The accumulating and strapping apparatus according to claim 1, further comprising:

a printing device configured to print information on the tape; and a control unit configured to store printing information including an operator ID, a date/time, a serial number, assignment information, a bank logo, a manager signature image, and each country language font, and supply, to the printing device, the printing information to be printed on the tape.

* * * * *